US008789973B2

(12) United States Patent
Li

(10) Patent No.: US 8,789,973 B2
(45) Date of Patent: Jul. 29, 2014

(54) LIQUID COOLED LED LIGHTING DEVICE

(75) Inventor: Kenneth Li, Castaic, CA (US)

(73) Assignee: Wavien, Inc., Valencia, CA (US)

( * ) Notice: Subject to any disclaimer, the term of this patent is extended or adjusted under 35 U.S.C. 154(b) by 354 days.

(21) Appl. No.: 13/092,112

(22) Filed: Apr. 21, 2011

(65) Prior Publication Data

US 2011/0261563 A1 Oct. 27, 2011

Related U.S. Application Data

(60) Provisional application No. 61/438,389, filed on Feb. 1, 2011, provisional application No. 61/327,180, filed on Apr. 23, 2010.

(51) Int. Cl.
*F21V 29/00* (2006.01)

(52) U.S. Cl.
USPC ..... 362/294; 362/235; 362/249.02; 362/373; 313/11; 313/35; 313/498

(58) Field of Classification Search
USPC ..... 362/235, 294, 249.02, 373, 547, 327, 362/227; 313/11, 35, 36, 46, 498
See application file for complete search history.

(56) References Cited

U.S. PATENT DOCUMENTS

| | | | |
|---|---|---|---|
| 5,005,108 | A | 4/1991 | Pristash et al. |
| 5,137,079 | A | 8/1992 | Anderson |
| 5,142,387 | A | 8/1992 | Shikama et al. |
| 5,305,184 | A | 4/1994 | Andresen et al. |
| 5,373,417 | A | 12/1994 | Barrett |
| 5,400,426 | A | 3/1995 | de Jong et al. |
| 5,982,540 | A | 11/1999 | Koike et al. |
| 6,144,536 | A | 11/2000 | Zimmerman et al. |
| 6,227,682 | B1 | 5/2001 | Li |
| 6,234,765 | B1 | 5/2001 | Deak |
| 6,341,876 | B1 | 1/2002 | Moss et al. |
| 6,869,206 | B2 | 3/2005 | Zimmerman et al. |
| 7,052,150 | B2 | 5/2006 | Dewald |
| 7,390,116 | B2 | 6/2008 | Jain |
| 7,494,228 | B2 | 2/2009 | Harbers et al. |
| 2004/0002169 | A1 | 1/2004 | Kraus et al. |
| 2004/0004435 | A1 | 1/2004 | Hsu |
| 2004/0233679 | A1 | 11/2004 | Ferri et al. |
| 2005/0002169 | A1 | 1/2005 | Drazic et al. |
| 2005/0168990 | A1 | 8/2005 | Nagata et al. |
| 2005/0207177 | A1 | 9/2005 | Guy |
| 2005/0225866 | A1 | 10/2005 | Abu-Ageel |

(Continued)

OTHER PUBLICATIONS

PCT International Search Report and Written Opinion for PCT/US2011/033501 dated Jul. 7, 2011.

(Continued)

*Primary Examiner* — Anh Mai
*Assistant Examiner* — Kevin Quarterman
(74) *Attorney, Agent, or Firm* — Abelman, Frayne & Schwab

(57) ABSTRACT

A liquid cooled LED lighting device includes a sealed housing containing an LED element that emits light. Cooling liquid is contained in the housing to disperse heat generated by the LED element. An enclosure containing compressible material is preferably immovably positioned within the housing and outside of the optical path of the emitted light. The enclosure containing the compressible material compresses in response to expansion of the cooling liquid as it absorbs heat from the LED element. Advantageously, the cooling liquid and the enclosure containing the compressible material act to more efficiently cool the LED element, thereby providing higher light output and increased lifetime of the LED element.

44 Claims, 7 Drawing Sheets

(56) References Cited

U.S. PATENT DOCUMENTS

| | | | | |
|---|---|---|---|---|
| 2006/0008237 | A1 | 1/2006 | Imade | |
| 2006/0062013 | A1 | 3/2006 | Imade | |
| 2006/0090881 | A1* | 5/2006 | Tuma | 165/104.21 |
| 2006/0144570 | A1 | 7/2006 | Crocker et al. | |
| 2006/0203352 | A1 | 9/2006 | Pashley | |
| 2006/0209545 | A1 | 9/2006 | Yu | |
| 2006/0262514 | A1 | 11/2006 | Conner et al. | |
| 2007/0058059 | A1* | 3/2007 | Suehiro | 348/294 |
| 2007/0133171 | A1 | 6/2007 | Cheon | |
| 2007/0236956 | A1 | 10/2007 | Kolodin et al. | |
| 2007/0284565 | A1 | 12/2007 | Leatherdale et al. | |
| 2007/0291491 | A1 | 12/2007 | Li et al. | |
| 2008/0030974 | A1 | 2/2008 | Abu-Ageel | |
| 2008/0219007 | A1* | 9/2008 | Heffington et al. | 362/294 |
| 2009/0001372 | A1 | 1/2009 | Arik et al. | |
| 2009/0015125 | A1* | 1/2009 | Shuy | 313/46 |
| 2009/0141491 | A1* | 6/2009 | Chu | 362/231 |
| 2010/0045937 | A1 | 2/2010 | Li | |
| 2010/0328950 | A1* | 12/2010 | Lai et al. | 362/249.02 |

OTHER PUBLICATIONS

Hoepfner: "61.1: Invited Paper: PhlatLight™ Photonic Lattice LEDs for RPTV Light Engines," SID 06 Digest, 1808-1811 (2006).

"LED Light Bulb—4W Globe—Eternaleds HydraLux-4," eternaleds.com, [http://www.eternaleds.com/4W_LED_Globe_A_Shape_Bulb_Eternaleds_HydraLux_p/hydralux-4.htm]. Website first accessed Jan. 7, 2007, per Internet Archive Wayback Machine [archive.org].

* cited by examiner

LIQUID COOLED LED LIGHTING DEVICE

CROSS REFERENCE TO RELATED APPLICATIONS

This application claims the benefit of priority under 35 U.S.C. Section 119(e) to U.S. Provisional Application Ser. No. 61/438,389, filed Feb. 1, 2011 and Provisional Application Ser. No. 61/327,180, filed Apr. 23, 2010, which are fully incorporated by reference herein.

FIELD OF THE INVENTION

The present invention relates to a lighting device and more particularly to an LED lighting device.

BACKGROUND OF THE INVENTION

For many illumination applications in LED (light emitting diode) illumination or lighting, an important issue is the removal of heat generated from an LED lighting element of an LED chip. Traditionally, LED chips have been mounted on a metal substrate and the substrate is mounted on a heatsink with cooling fins. A fan can then be used to blow air over the heatsink fins to cool the LED chip.

However, due to the relatively large distance between the LED chip and the heatsink fins, the cooling efficiency is usually low. As a result, the LED junction operates at higher temperatures, which reduces the light output and lifetime of the LED chip.

Therefore, it would be desirable to provide an LED light device and method of more efficiently cooling the LED lighting element.

SUMMARY OF THE DISCLOSURE

According to one aspect of the present invention, a liquid cooled LED lighting device includes a sealed housing having a transmissive aperture and an LED element contained in the housing. The LED element has an emitting area that emits light for transmission through the aperture. Cooling liquid is contained in the housing to disperse heat generated by the LED element. Preferably, compressible material enclosed in an enclosure is positioned within the housing and outside of the optical path of the emitted light. The enclosure containing the compressible material compresses in response to expansion of the cooling liquid as it absorbs heat from the LED element.

Advantageously, the cooling liquid and compressible material act to more efficiently cool the LED element, thereby providing higher light output and increased lifetime. At the same time, use of the compressible material in the housing allows the housing to be made of a completely sealed rigid package.

According to another aspect of the present invention, a liquid cooled LED lighting device includes a sealed housing having a recycling reflector. The recycling reflector has a reflective surface such that the LED light impinging on the reflective surface reflects back to the emitting area of the LED element. The cooling liquid and compressible material contained in the housing act to disperse heat generated by the LED element.

According to another aspect of the present invention, a liquid cooled LED lighting device includes an LED element which is attached to the outside of the sealed housing. The cooling liquid and compressible material contained in the housing act to disperse heat generated by the LED element.

DETAILED DESCRIPTION OF THE INVENTION

Figure 1:
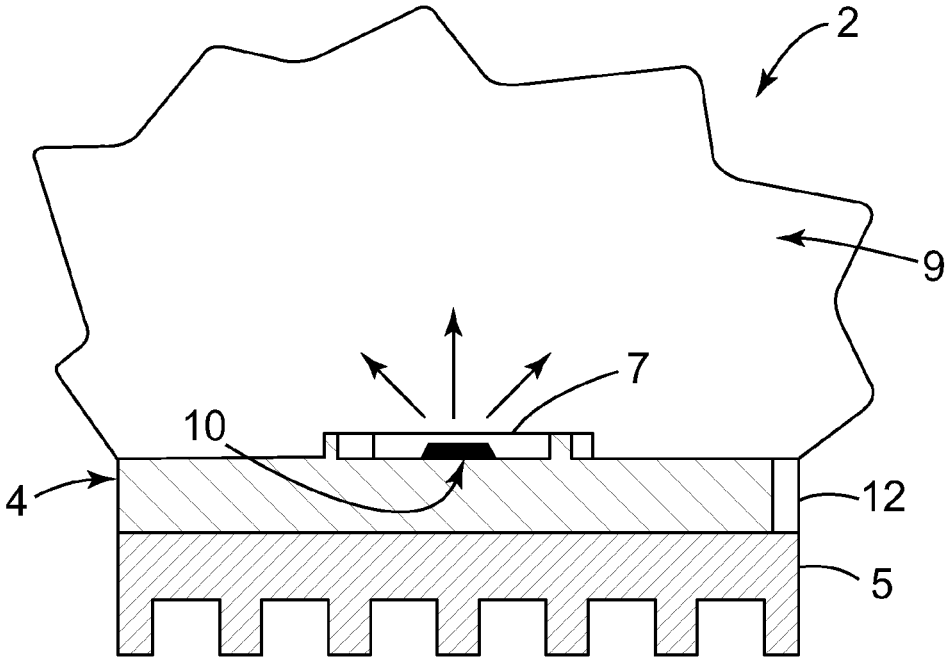
FIG. 1 shows an exemplary LED lighting device according to an embodiment of the present invention.

FIG. 1 shows an exemplary LED lighting device according to one embodiment of the present invention. The LED lighting device 2 includes an LED package 4, heatsink 5, and cooling liquid 9.

The LED package 4 includes at least one LED chip 10 which is typically an LED element having an emitting area that emits light and a substrate 12 on which the chip is mounted. The emitting area includes an optional transparent window 7 that protects the LED chip 10. The heatsink 5 is attached to the substrate 12 to carry heat away from the LED chip 10. Such LED packages, for example, are available from Luminus Devices, Inc. of Billerica, Mass.

Cooling liquid 9 contained in a liquid sealed housing is positioned in close proximity to or near the LED chip 10. In FIG. 1, the boundary of the housing containing the cooling liquid is not shown as it can be used in many different applications that use different types of housings. Preferably, the cooling liquid 9 is in direct contact with the LED chip 10 (i.e., the LED semiconductor itself or the window 7) so that any heat generated by the chip will be carried away by the liquid immediately with very little heat resistance. In the case of FIG. 1, the cooling liquid 9 is in direct contact with the transparent window 7 of the chip. In cases where the transparent window 7 is absent, the cooling liquid 9 will be in direct contact with the LED semiconductor itself. Preferably, the cooling liquid 9 has low thermal expansion, high heat conductivity, chemically inert, and electrically insulating characteristics. One such liquid is a perfluorinated liquid called Fluorinert™ available from 3M Company of St. Paul, Minn. Other lower cost liquids can be mineral oil, paraffin or the like.

Figure 2:
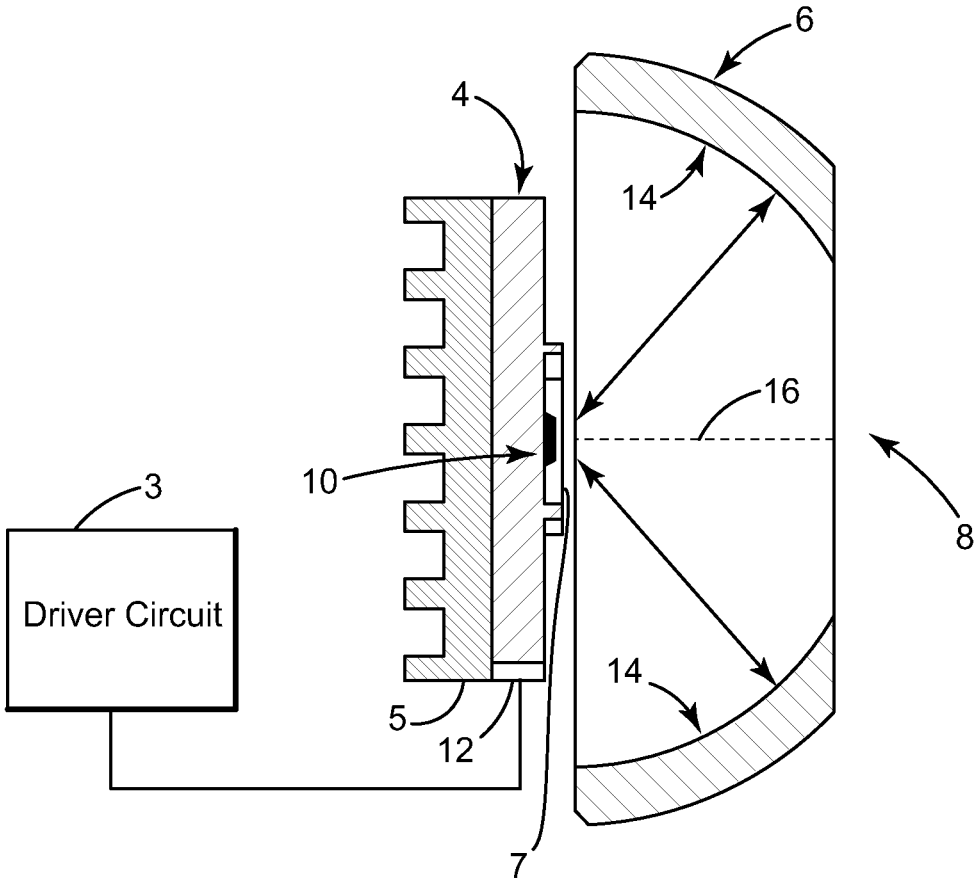
FIG. 2 shows an LED lighting device having a recycling reflector.

FIG. 2 shows an LED lighting device with a recycling reflector as disclosed in applicant's earlier filed application Ser. No. 13/077,006, filed Mar, 31, 2011, which is incorporated herein by reference. The LED lighting device includes an LED package 4, a driver circuit 3 for driving the LED chips 10, a recycling reflector 6 such as a recycling collar positioned in front of the LED chip and a transmissive aperture 8 through which the LED light passes.

The LED chips/elements 10 can be a single chip or multiple chips of white color, single color, or multiple color. For particular applications, they can be arranged such that the optical axis 16 of the transmissive aperture 8 of the recycling reflector 6 goes through the center 20 (see FIG. 3) of the LED elements and the center is also substantially at the proximity of the center of curvature of the recycling reflector. The LED elements 10 are preferably arranged in the same plane and closely positioned to minimize any space between any two emitting areas of the LED elements. The LED elements 10 can emit light of a single color such as red, green and blue or emit white light. The emission angle is typically 180 degrees or less.

The recycling collar 6 is curved in a concave manner relative to the LED element 10. The inner surface 14 is a reflective surface such that the LED light that impinges on the inner surface is reflected back to the light source, i.e., LED elements. The reflective surface can be provided by coating the exterior or interior surface of the collar 6 or by having a separate reflective mirror attached to the collar. According to a preferred embodiment, the recycling collar 6 is spherical in shape relative to the center 20 of the LED elements 10 such that the output is reflected back to itself with unit magnification. Thus, it is effectively an imaging system where the LED elements 10 form an image on to itself. Advantageously, substantially all LED light that impinges on the inner spherical reflective surface 14 is reflected back to the light source, i.e., emitting areas of the LED elements 10.

As persons of ordinary skill in the art can appreciate, any LED light that does not pass through the transmissive aperture of a conventional illumination system is lost forever. However, by using the curved reflective surface 14, the LED lighting device of the present invention allows recovery of a substantial amount of light that would have been lost. For example, in an illumination system whose transmissive aperture size captures about 20% of emitted light, the recycling collar 6 allows collection of an additional 20% of the emitted light. Advantageously, that is an improvement of 100% in captured light throughput, which results in a substantial improvement in brightness.

The LED in the present invention can be a single LED or an array of LEDs. The LED can be white, single color, or composed of multiple chips with single or multiple colors. The LED can also be a DC LED, or an AC LED.

Figure 3A:
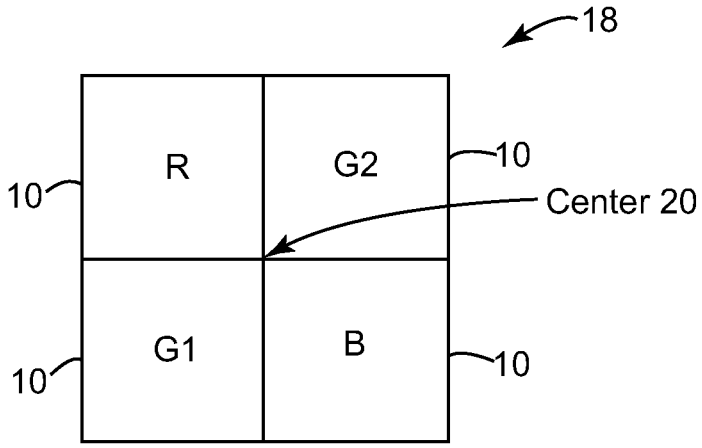
FIG. 3A shows an LED array of four LED elements with at least one symmetrically arranged colored pair.

FIG. 3 shows some of the LED chips that can be used with the present invention. FIG. 3A shows an LED array 18 of four colored LED elements 10. Specifically, the LED array 18 includes one red LED element R emitting red color light, one blue LED element B emitting blue color light arranged at opposite corners and symmetrically about the center 20, and two green LED elements G1,G2 emitting green color light arranged at opposite corners and symmetrically about the center 20 of the LED array. The LED array 18 is arranged such that the optical axis 16 of the recycling reflector 6 passes through the center 20 and the center is also substantially at the proximity of the center of curvature of the recycling reflector 6.

While the LED array 18 is shown with four LED elements, the present invention can work with at least one LED element. Also, in the case of a pair of LED elements, while it is preferable that the LED elements in the pair emit the same color, they can emit different colors although the efficiency may be lower. Moreover, the size of each LED element in the array can be different from any other LED element.

It is to be noted that while each LED element 10 is shown as a square, it can be rectangular. Preferably, the total emitting area of the LED array 18 should have the same aspect ratio as the image to be projected. For example, to project a high definition television image whose aspect ratio is 9:16, the total emitting area of the LED array 18 should have the same 9:16 dimension. Similarly, the dimension of the LED array 18 can be, among others, 4:3, 1:1, 2.2:1, which are also popular aspect ratios.

In the embodiment of FIG. 3A, the two green LED elements G1,G2 are imaged on to each other. Specifically, any light from LED element G1 impinging on the interior reflective surface 14 is reflected back to the symmetrically positioned LED element G2 and vice versa. For the symmetrically arranged same color LED elements to work well, the driver circuit 3 drives the same color LED elements (e.g., G1,G2) simultaneously. Thus, this arrangement provides high recycling efficiency. On the other hand, light from the blue LED element B is imaged onto the red LED element R and vise versa. Thus, the recycling efficiency is lower for these two colors.

Figure 3B:
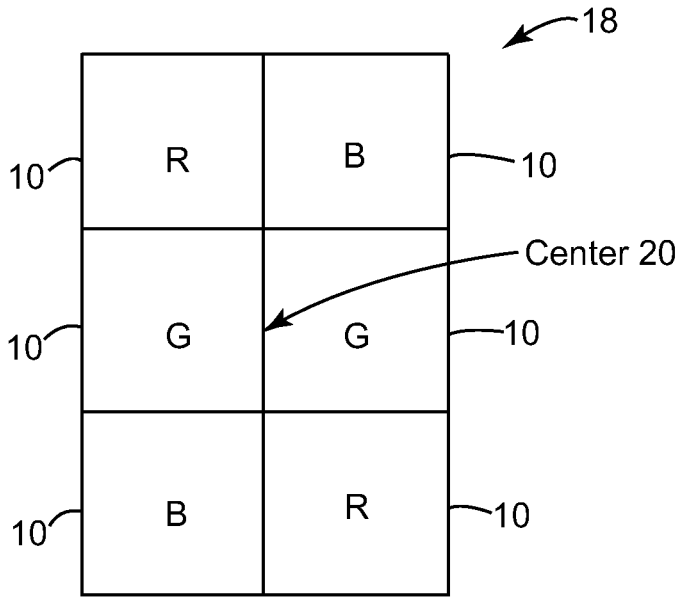
FIG. 3B shows an LED array of six symmetrically arranged LED elements.

In order to increase the efficiency with multi-colored LED elements, a symmetric configuration as shown in FIG. 3B can be used. In this embodiment, the red chips (LED elements R) are arranged symmetrically with respect to the center 20. As such, the red chips are imaged onto each other with high recycling efficiency. Similarly, the blue chips (LED elements B) and green chips (LED elements G) are also arranged symmetrically with respect to the center 20 and will be imaged onto each other with high recycling efficiency.

Figure 4:
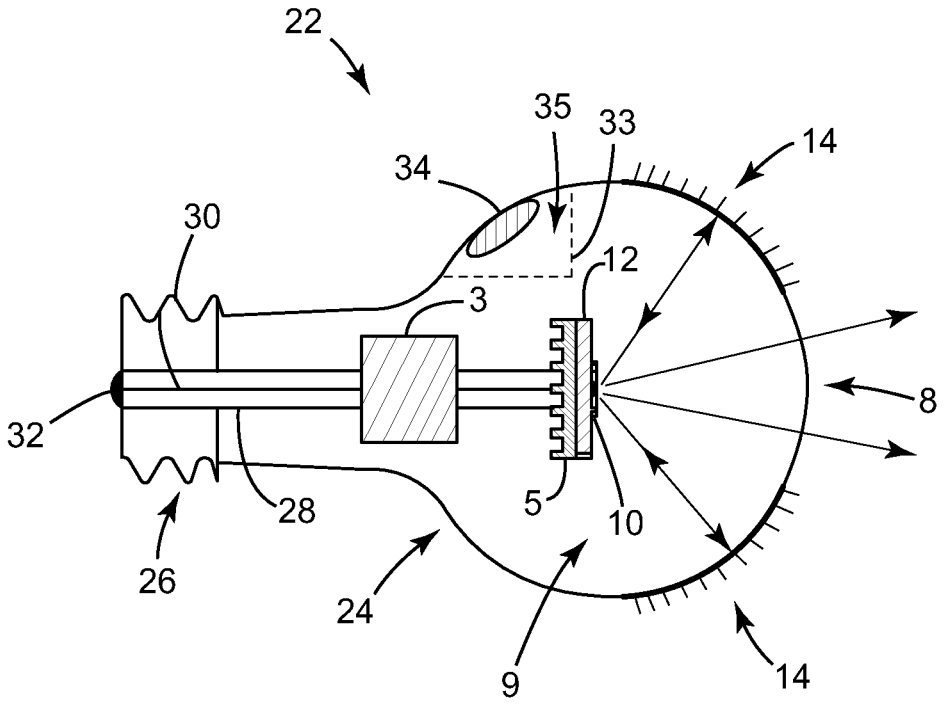
FIG. 4 shows a liquid cooled LED lighting device invention in which the light output is recycled to allow higher output intensity according to an embodiment of the present invention.

FIG. 4 shows a liquid cooled LED lighting device invention in which the light output is recycled to allow higher output intensity according to an embodiment of the present invention. In FIG. 4, the LED lighting device is an LED light bulb 22 having a sealed housing/bulb 24 and a base 26. The sealed bulb 24 can be made of plastic, glass or metal.

An LED mount 28 is attached to the base 26 and provides the rigid support structure for attaching a control circuit 3, heat sink 5, substrate 12 and LED chips 10 which are electrically connected to the control circuit. The substrate 12 supporting the LED chip 10 is mounted on the heatsink 5. The LED mount 28 also has a conduit for carrying electrical wires from the control circuit to an electrical foot contact 32 and screw threaded contact 30. In operation, line voltage from the electrical contacts 30,32 is converted to the desired level for the LED chip 10 by the control/driver circuit 3.

Although FIG. 4 shows a light bulb having an Edison type threaded base connector, any other LED lighting devices such as one having MR-16 type base are also suitable for use with the present invention.

The bulb 24 has an optically transparent transmissive aperture 8 through which the emitted light from the LED chip 10 passes. The aperture 8 can be a simple optically transparent spherical window or can have a lens such as a focusing lens or collimating lens to obtain a desired output divergence.

The part of the bulb 24 above the substrate 12 is spherically shaped relative to the center of the LED chip 10 emitting area. A part of the spherical bulb surface around the transmissive aperture 8 is coated with reflective coating 14 for reflecting the emitted light back to the LED chip 10 light emitting area. This functions as the recycling collar 6 as shown in FIG. 2.

According to the invention, the sealed light bulb 24 is filled with cooling liquid 9 for heat sinking. Similar to FIG. 1, the sealed cooling liquid 9 is positioned in close proximity to or near the LED chip 10. As shown, the cooling liquid 9 is in direct contact with the LED chip 10 emitting area so that any heat generated by the chip will be carried away by the liquid immediately with very little heat resistance.

The LED chip 10 generates heat when emitting light. The heat in turn heats the cooling liquid 9 which expands in volume. Since the cooling liquid 9 is sealed inside the bulb 24, a relief is needed to prevent explosion due to expansion of the cooling liquid. As shown in FIG. 4, compressible material 34 is positioned inside the bulb to absorb the expanding volume of the cooling liquid 9 by compressing. In the embodiment shown, the compressible material 34 is immovably positioned and is outside of the optical path of the emitted light so that it does not interfere with the light being transmitted through the transmissive aperture 8. If not, the compressible material 34 may travel into the optical path of the light and create distortions and shadows in the light exiting the aperture 8 and may also reduce the light output.

In FIG. 4, the compressible material 34 is attached to the inner surface of the bulb 24. Alternatively, the compressible material 34 can be immovably attached to the LED mount 28, heat sink or other parts within the bulb 24 so long as the material is positioned outside of the optical path of the emitted light. In some embodiment the compressible material is contained in a sealed enclosure as shown in FIG. 4.

The compressible material as shown in FIG. 4 is a pocket of air. The air pocket is contained inside a small sealed balloon enclosure. As the pressure inside the bulb 24 increases, the air pocket 34 will reduce in volume, relieving the pressure inside the light bulb.

Instead of positioning the compressible material 34 inside the housing 24, a part of the housing can be made of flexible material such as rubber so that it can expand as the cooling liquid 9 expands. However, this is not a preferred solution because it is difficult to maintain a seal between the flexible material and the rigid housing. Thus, positioning of the compressible material 34 inside the housing 24 according to the present invention allows the housing to be made entirely of rigid, non-expanding material which is completely sealed, thereby improving the reliability and durability of the LED lighting device.

In an alternative embodiment, the compressible material 34 such as air is contained in an enclosure and is confined within an internal chamber 35 defined by an internal wall 33 having openings so that the fluid 9 flows freely therethrough. In this way, the compressible material 34 do not need to be immovably positioned. Preferably, the wall 33 and therefore the compressible material 34 and its enclosure are outside of the optical path of the emitted light.

Although the embodiment of FIG. 4 shows air as the compressible material, any other types of gas, which by nature are compressible, such as nitrogen can be used. In fact, even vacuum can be used so long as the enclosure is sufficiently rigid to withstand the force of vacuum, yet sufficiently flexible to compress due to the external pressure of the expanding cooling liquid 9.

FIG. 5 shows various types of enclosures for enclosing compressible materials according to the present invention. FIG. 5A is a section of tubing containing air with both ends sealed. The tubing can be rubber, silicone, plastic or the like.

Figure 5A:
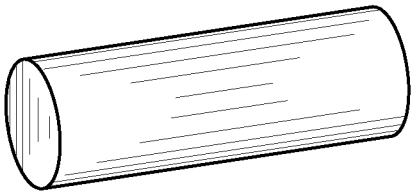
FIGS. 5A-5E shows various types of enclosures that can be used to enclose compressible materials according to the present invention.
Figure 5B:
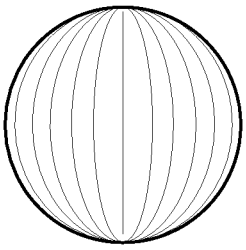
Figure 5C:
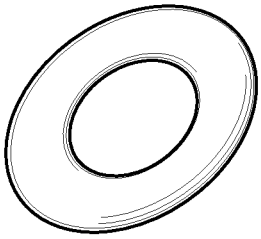
Figure 5D:
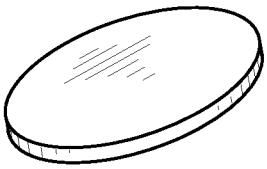

The shape of the enclosure can be cylindrical as shown in FIG. 5A, spherical as shown in FIG. 5B, toroidal as shown in FIG. 5C, a flat cavity such as a disk as shown in FIG. 5D, or the like. The air pocket can be independent of the package, or can be attached to the package, or can be integrated with the package.

Figure 5E:
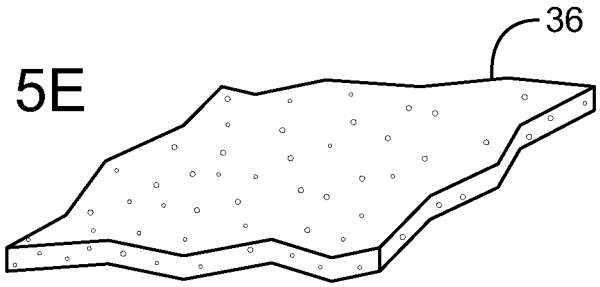

As shown in FIG. 5E, the compressible material 34 can be a collection of small air pockets packed together as a piece of "foam". Such materials provide the necessary volume of gas required that is easy to handle and that can be cut to size as needed. The foam material can be found in packing cushion materials, for example. Materials that make up these foams could be vinyl, silicone, rubber, etc. The gas inside the pockets can be air, nitrogen, or the like.

To enhance the efficiency of cooling and heat sinking, a pump 38 can be added to circulate the cooling liquid inside the housing 24. The pump 38 quickly moves away the hot liquid near the LED chips 10 and replaced it with cooler liquid, thereby increasing the efficiency of cooling in order to reduce the junction temperature of the LED chips.

In a preferred embodiment, the pump 38 is an ultrasonic pump. Ultrasonic signal is used to drive a transducer such that it generates acoustic waves in the cooling liquid 9. The configuration of the pump 38 is such that the acoustic wave produces a net flow of liquid.

Figure 6A:
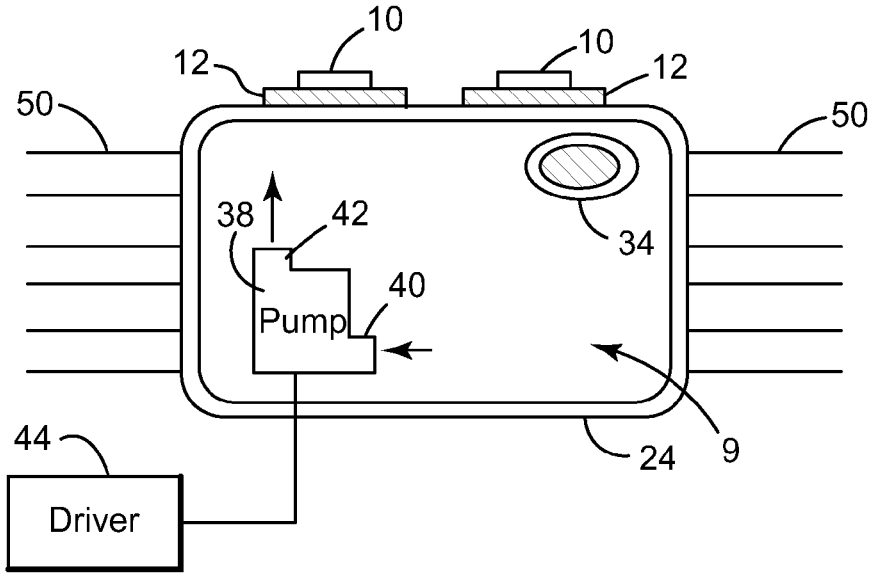
FIG. 6A shows an LED lighting device having a pump according to an embodiment of the present invention.

FIG. 6A shows an LED lighting device with such a pump. The liquid sealed housing 24 contains an ultrasonic pump 38 having an inlet 40 on one side and an outlet 42 on another side. The ultrasonic pump 38 is driven by an ultrasonic driver circuit 44 located outside the housing 24 that generates an ultrasonic drive signal. In FIG. 6A, the substrate 12 and LED chip 10 attached to the substrate are mounted to the outer surface of the housing 24 instead of being attached to the inside of the housing as shown in FIG. 4. Cooling fins 50 are attached to the housing 24 to remove heat from the cooling liquid 9. Preferably, the housing 24 in FIG. 6A is made of heat conductive material such as metal or metal alloy.

The air pocket 34 in FIG. 6A is similar to that of FIG. 4, except that since the LED chip 10 is attached to the outside of the housing 24, the air pocket does not have to be immovably attached to the housing 24.

Figure 6B:
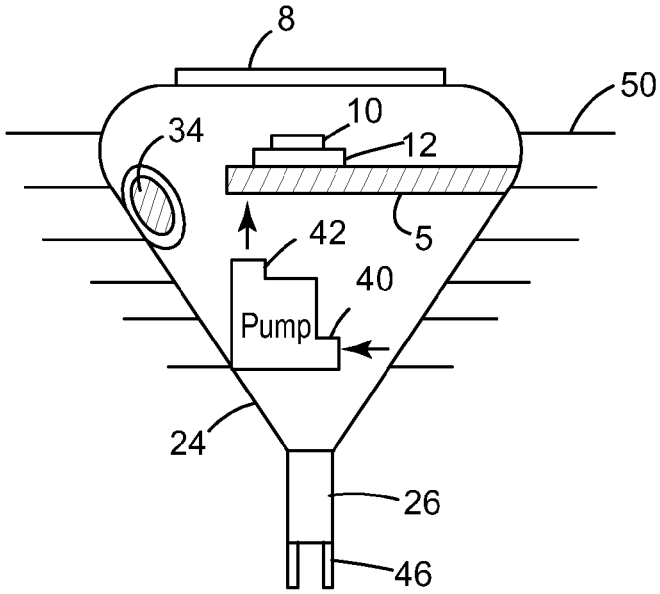
FIG. 6B shows an LED lighting device having a pump and an LED element in contact with a cooling liquid according to an embodiment of the present invention.

FIG. 6B shows an alternative LED lighting device in which the LED chip 10 and internal heat sink 5 are immersed in the cooling liquid 9 for effective cooling. The compressible material 34 is similar to that of FIG. 4 and is attached to the interior surface of the liquid sealed housing 24 away from the optical path of the LED chip 10. Fins 50 are attached to the housing 24 to remove heat from the cooling liquid 9. Preferably, the housing 24 in FIG. 6B is made of heat conductive material such as metal or metal alloy.

The heatsink 5 is attached to the interior surface of the housing 24 so that the heat from the heatsink can be redistributed throughout the housing. The base 26 attached to the housing 24 couples electrical wires from the LED chip 10 and pump 38 to connectors 46. The light emitting from the LED chip 10 is transmitted through the aperture/optical window 8.

Figure 7:
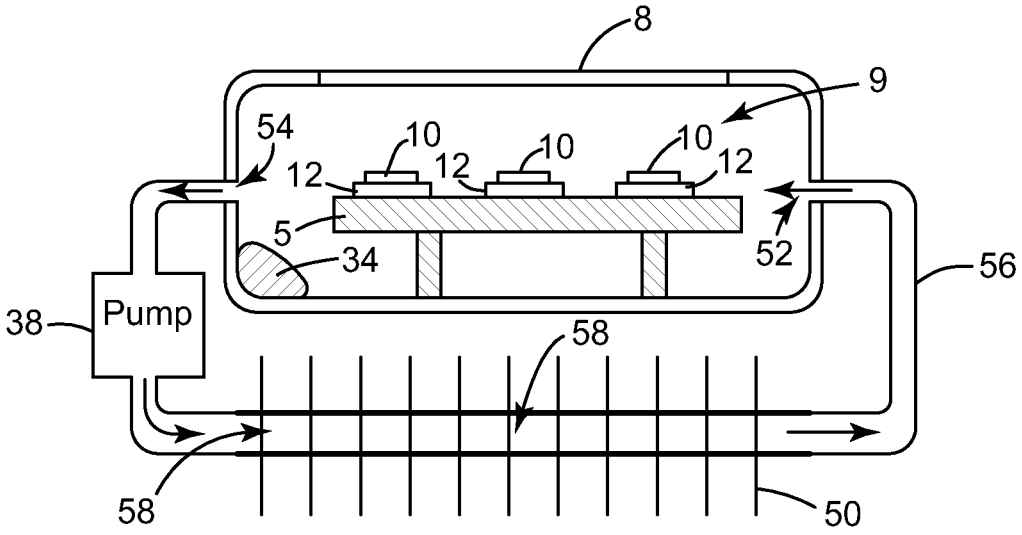
FIG. 7 shows an LED lighting device having an external pump according to an embodiment of the present invention.

FIG. 7 shows an LED lighting device according to another embodiment of the present invention. An array of LED chips 10 and substrate 12 are mounted on a heatsink 5 attached to the interior surface of the housing 24. The compressible material 34 is attached to the interior surface of the housing 24 and is positioned outside of the optical path of the emitted light. The housing 24 has an inlet 52 and outlet 54. A flow tube 56 is coupled between the inlet 52 and outlet 54. Cooling fins 50 are attached to a portion of the flow tube 56 defining a cooling chamber 58. A pump such as an ultrasonic pump 38 is connected inline with the flow tube 56 to pump the cooling liquid 9 from the housing 24 to the cooling chamber 58 for efficient heat sinking by the cooling fins.

The above disclosure is intended to be illustrative and not exhaustive. This description will suggest many modifications, variations, and alternatives may be made by ordinary skill in this art without departing from the scope of the invention. Those familiar with the art may recognize other equivalents to the specific embodiments described herein. For example, although the present invention is shown with a recycling reflector, it can be used without the recycling of light. Also, while the present invention has been shown in the context of an LED as the light source, it can be used with any light source that generates a significant amount of heat in operation. For example, the present invention can be used with laser, arc lamp, or the like. The principles of the present invention can also be applied to any other non-optical applications where heat is generated such as power transistors, microprocessors, inductors, rectifiers and transformers. Accordingly, the scope of the invention is not limited to the foregoing specification.

What is claimed is:

1. A liquid cooled LED lighting device comprising: a sealed housing having a transmissive aperture; an LED element contained in the housing and having an emitting area that emits light for transmission through the aperture; a cooling liquid filling the housing and in contact with the LED element to absorb and disperse heat generated by the LED element; and a compressible material positioned within the housing, the compressible material operable to compress in response to expansion of the cooling liquid.

2. The LED lighting device of claim 1, wherein the compressible material is contained in an enclosure positioned outside of the optical path of the emitted light.

3. The LED lighting device of claim 2, wherein the enclosure containing the compressible material is immovably positioned within the housing.

4. The LED lighting device of claim 2, wherein the enclosure containing the compressible material is immovably positioned outside of the optical path of the emitted light.

5. The LED lighting device of claim 1, wherein the cooling liquid includes perfluorinated liquid.

6. The LED lighting device of claim 1, wherein the compressible material is air or nitrogen.

7. The LED lighting device of claim 2, wherein the enclosure includes a balloon.

8. The LED lighting device of claim 2, wherein the enclosure includes a tube having sealed ends.

9. The LED lighting device of claim 2, wherein the enclosure includes a spherical, toroidal or disc enclosure.

10. The LED lighting device of claim 1, wherein the enclosure includes a foam material containing a plurality of sealed gas pockets.

11. The LED lighting device of claim 1, further comprising a heatsink disposed inside the housing and attached to the LED element.

12. The LED lighting device of claim 1, further comprising a pump that circulates the cooling liquid to disperse the heat generated by the LED element.

13. The LED lighting device of claim 12, wherein the pump is disposed inside the housing.

14. The LED lighting device of claim 12, wherein the pump is an ultrasonic pump and is disposed inside the housing.

15. The LED lighting device of claim 12, wherein: the housing has an inlet and an outlet; and the pump is connected between the inlet and outlet, and is disposed outside of the housing.

16. The LED lighting device of claim 15, further comprising: a liquid chamber in fluid communication with the pump; and a plurality of cooling fins attached to the chamber.

17. The LED lighting device of claim 1, wherein the housing includes a recycling reflector having a reflective surface to reflect the emitted light back to the emitting area of the LED element.

18. The LED lighting device of claim 17, wherein the reflective surface is spherical in shape relative to the center of the emitting area of the LED element.

19. The LED lighting device of claim 18, wherein the LED element includes an LED array having at least one pair of LED elements emitting the same color and being symmetrically arranged about the center of the LED array such that the emitted light from one of the pair of LED elements is reflected back to the other one of the pair of LED elements.

20. The LED lighting device of claim 18, wherein the LED element includes one or more LED elements.

21. The LED light device of claim 18, wherein the LED element emits one or more colors.

22. The LED lighting device of claim 1, wherein the aperture includes a lens.

23. The LED lighting device of claim 1, further comprising a base attached to the housing and having a screw threaded contact.

24. A liquid cooled LED lighting device comprising: an LED element having an emitting area that emits light; a sealed housing having a transmissive aperture through which the emitted light passes, and a recycling reflector having a reflective surface, wherein the emitted light impinging on the reflective surface reflects back to the emitting area of the LED element; a cooling liquid filling the housing and in contact with the LED element to absorb and disperse heat generated by the LED element; and compressible material contained in the housing and operable to compress in response to expansion of the cooling liquid.

25. The LED lighting device of claim 24, wherein the reflective surface is spherical in shape relative to the center of the emitting area of the LED element.

26. The LED lighting device of claim 25, wherein the LED element includes an LED array having at least one pair of LED elements emitting the same color and being symmetrically arranged about the center of the LED array such that the emitted light from one of the pair of LED elements is reflected back to the other one of the pair of LED elements.

27. The LED lighting device of claim 24, wherein the cooling liquid includes perfluorinated liquid.

28. The LED lighting device of claim 24, wherein the compressible material is air or nitrogen.

29. The LED lighting device of claim 24, wherein the compressible material is contained inside a balloon.

30. The LED lighting device of claim 24, wherein the compressible material is contained inside a tube having sealed ends.

31. The LED lighting device of claim 24, wherein the compressible material is contained inside a spherical, toroidal or disc enclosure.

32. The LED lighting device of claim 24, wherein the compressible material includes foam material containing a plurality of sealed air pockets.

33. The LED lighting device of claim 24, further comprising a pump that circulates the cooling liquid to disperse the heat generated by the LED element.

34. The LED lighting device of claim 33, wherein the pump is disposed inside the housing.

35. The LED lighting device of claim 33, wherein: the housing has an inlet and an outlet; and the pump is connected between the inlet and outlet, and is disposed outside of the housing.

36. The LED lighting device of claim 24, wherein the aperture includes a lens.

37. A liquid cooled LED lighting device comprising: a sealed housing having a transmissive aperture; an LED element attached to the outside of the housing and having an emitting area that emits light; a cooling liquid filling the housing and in thermal contact with the LED element to absorb and disperse heat generated by the LED element; and a compressible material contained in the housing and operable to compress in response to expansion of the cooling liquid.

38. The LED lighting device of claim 37, further comprising a plurality of cooling fins attached to the housing.

39. The LED lighting device of claim 37, wherein the cooling liquid includes perfluorinated liquid.

40. The LED lighting device of claim 37, wherein the compressible material includes air or nitrogen contained in a sealed enclosure.

41. The LED lighting device of claim 37, wherein the compressible material includes foam material containing a plurality of sealed air pockets.

42. The LED lighting device of claim 37, further comprising a pump that circulates the cooling liquid to disperse the heat generated by the LED element.

43. The LED lighting device of claim 42, wherein the pump is disposed inside the housing.

44. The LED lighting device of claim 42, wherein: the housing has an inlet and an outlet; and the pump is connected between the inlet and outlet, and is disposed outside of the housing.

* * * * *